US007482540B2

(12) United States Patent
Shukushima et al.

(10) Patent No.: US 7,482,540 B2
(45) Date of Patent: Jan. 27, 2009

(54) FLAT CABLE

(75) Inventors: Satoshi Shukushima, Tochigi (JP); Takayoshi Koinuma, Tochigi (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 11/741,215

(22) Filed: Apr. 27, 2007

(65) Prior Publication Data

US 2008/0041611 A1 Feb. 21, 2008

(51) Int. Cl.
*H01B 7/36* (2006.01)

(52) U.S. Cl. ..... 174/117 R; 174/117 F; 174/117 FF

(58) Field of Classification Search ..... 174/110 R, 174/113 R, 117 R, 117 F, 117 FF
See application file for complete search history.

(56) References Cited

U.S. PATENT DOCUMENTS

2005/0211461 A1* 9/2005 Horikoshi et al. ..... 174/117 FF
2006/0011374 A1* 1/2006 Sakamoto ..... 174/117 F

FOREIGN PATENT DOCUMENTS

JP 10-046385 2/1998
JP 2001-043743 2/2001

* cited by examiner

*Primary Examiner*—William H Mayo, III
(74) *Attorney, Agent, or Firm*—Global IP Counselors, LLP

(57) ABSTRACT

A flat cable includes a plurality of flat conductors each including a copper substrate, the flat conductors being aligned in a plane, and an insulating resin that covers the flat conductors. At least a terminal part of each of the flat conductors has a tin-copper alloy layer on the copper substrate, and a zinc-containing tin plating layer on the tin-copper alloy layers. The thickness of the tin-copper alloy layer is at least 0.2 μm and not greater than 1.0 μm. The thickness of the zinc-containing tin plating layer is at least 0.2 μm and not greater than 1.5 μm. The total thickness of the tin-copper alloy layer and the zinc-containing tin plating layers is at least 0.4 μm and not greater than 1.7 μm.

2 Claims, 2 Drawing Sheets

FLAT CABLE

BACKGROUND OF THE INVENTION

1. Field of the Invention

The present invention relates to a flat cable used in, for example, electronic devices.

2. Description of the Background Arts

Size and weight reduction of electronic devices has lead to the miniaturization of the electronic components and wiring members installed in these devices. Wiring members are in demand that can be wired densely in limited space. Examples of such wiring members include flexible printed circuit boards, flat cables that use flat conductors, and electrical connectors used to connect the printed circuit boards or flat cables. With these wiring members, in which a large number of electrical conductors are densely arranged, the conductors are electrically insulated from each other and satisfactory electrical connections are required.

The electrical conductors are normally made of copper, which has good electrical conductivity, good ductility, and high strength, and is easily coated with other metals. For the wiring members that use copper, tin plating is commonly used for its corrosion resistance and soldering performance. Tin plating is normally formed by electroplating, and the formation of acicular crystal structures (hereinafter referred to as whiskers) on the surface of the tin plating is a known phenomenon.

When a copper-based metal material is plated with tin, the copper atoms are diffused throughout the tin plating film to create a copper-tin intermetallic compound. This intermetallic compound has a different crystal structure from tin, and strain is produced in the crystal lattice such that compressive stress is created in the tin plating film. This compressive stress acts as a drive force for whisker growth, and whiskers are therefore believed to form easily in cases in which a copper-based material is plated with tin. Whiskers are a cause of electrical short-circuiting between conductors, and various improvement measures have therefore been proposed.

Japanese Patent Application Laid-Open No. 2001-43743 discloses a flat cable that comprises a flat conductor plated with a tin-copper alloy to inhibit the formation of whiskers in the plating later. Japanese Patent Application Laid-Open No. 10-46385 discloses an electric/electronic circuit component that is covered with a tin-zinc alloy plating to inhibit the formation of whiskers.

As disclosed in these documents, whiskers can be inhibited to a certain extent with plating made of a tin-copper alloy or a tin-zinc alloy instead of tin alone. However, when terminal parts of flat cables are used as male contacts and connected to electrical connectors, the surface of the plating is subjected to external stress from the point of contact of the connector, whiskers are likely to form in a specific manner, and the whiskers increase in length. Therefore, in order to prevent whisker-induced short-circuiting in this portion, further measures must be taken to inhibit the formation and growth of whiskers.

SUMMARY OF THE INVENTION

An object of the present invention is to provide a flat cable that forms highly reliable connections and that has terminal parts in which the formation of whiskers is inhibited.

In order to achieve this object, the flat cable includes (1) a plurality of flat conductors each including a copper substrate, the flat conductors being aligned in a plane, and (2) an insulating resin that covers the flat conductors. At least a terminal part of each of the flat conductors has a tin-copper alloy layer on the copper substrate, and a zinc-containing tin-plating layer on the tin-copper alloy layers. The thickness of the tin-copper alloy layer is at least 0.2 μm and not greater than 1.0 μm. The thickness of the zinc-containing tin plating layer is at least 0.2 μm and not greater than 1.5 μm. The total thickness of the tin-copper alloy layer and the zinc-containing tin-plating layers is at least 0.4 μm and not greater than 1.7 μm. The thicknesses of these layers can be measured with an electrolytic coating thickness gauge. The zinc content in the zinc-containing tin-plating layers is preferably at least 0.2% and not greater than 20%. The zinc-containing tin plating layers preferably contain an amount at least 2% and not greater than 4% of bismuth.

According to the flat cable of the present invention, the amount of tin, which is a substantial source of whisker formation, is reduced by forming tin-copper alloy layers on the copper substrates constituting the flat conductors, and covering these alloy layers with zinc-containing tin plating layers, whereby the formation of whiskers can be reliably reduced without using lead, the length of the whiskers can be reduced, and whisker-induced short-circuiting can be prevented and connections can thereby be made much more reliable.

These and other features, aspects, and advantages of the present invention will be better understood through the following description, appended claims, and accompanying drawings. In the explanation of the drawings, an identical mark is applied to identical elements and an overlapping explanation will be omitted.

DETAILED DESCRIPTION OF THE INVENTION

Figure 1:
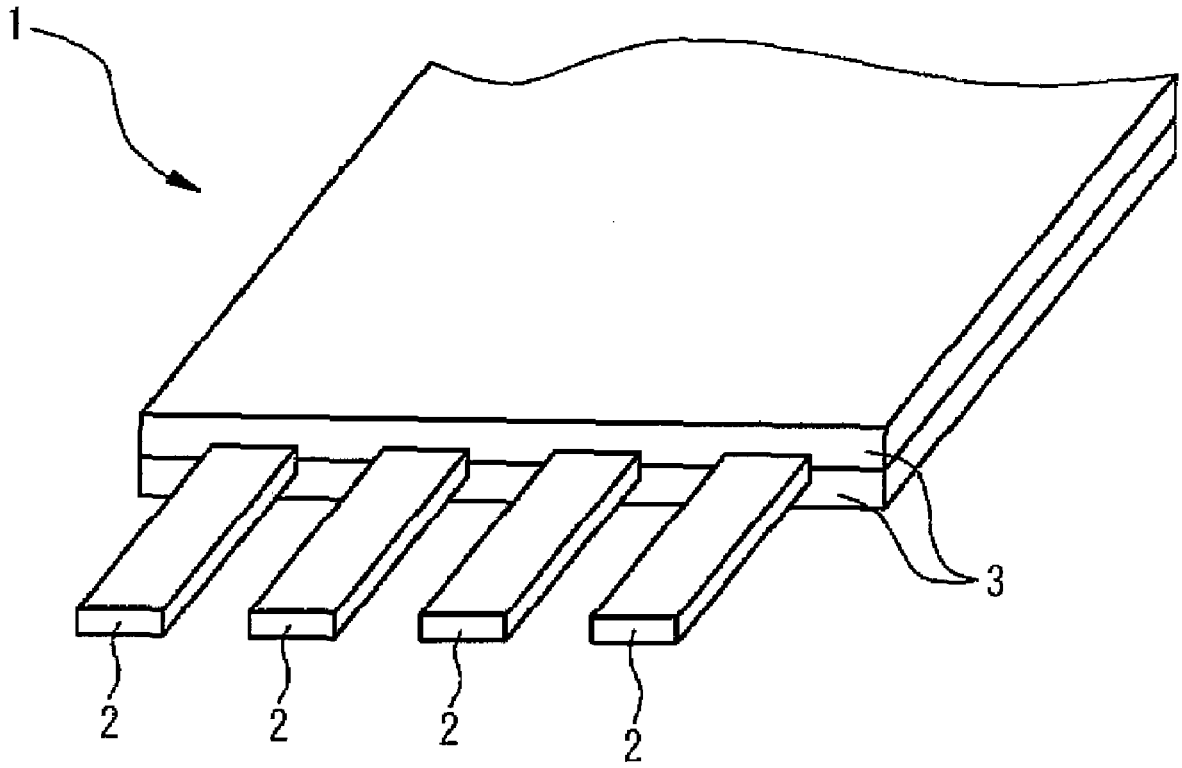
FIG. 1 is a perspective view showing an embodiment of the flat cable of the present invention.

FIG. 1 is a perspective view showing an embodiment of the flat cable of the present invention. The flat cable 1 has multiple flat conductors 2 aligned in a plane, and coverings 3 composed of insulating resin films laminated over the flat conductors 2 so as to put the conductor 2 therebetween. The terminal parts (known as electrical connecting portions) of the flat conductors 2 are exposed through the coverings 3.

Figure 2:
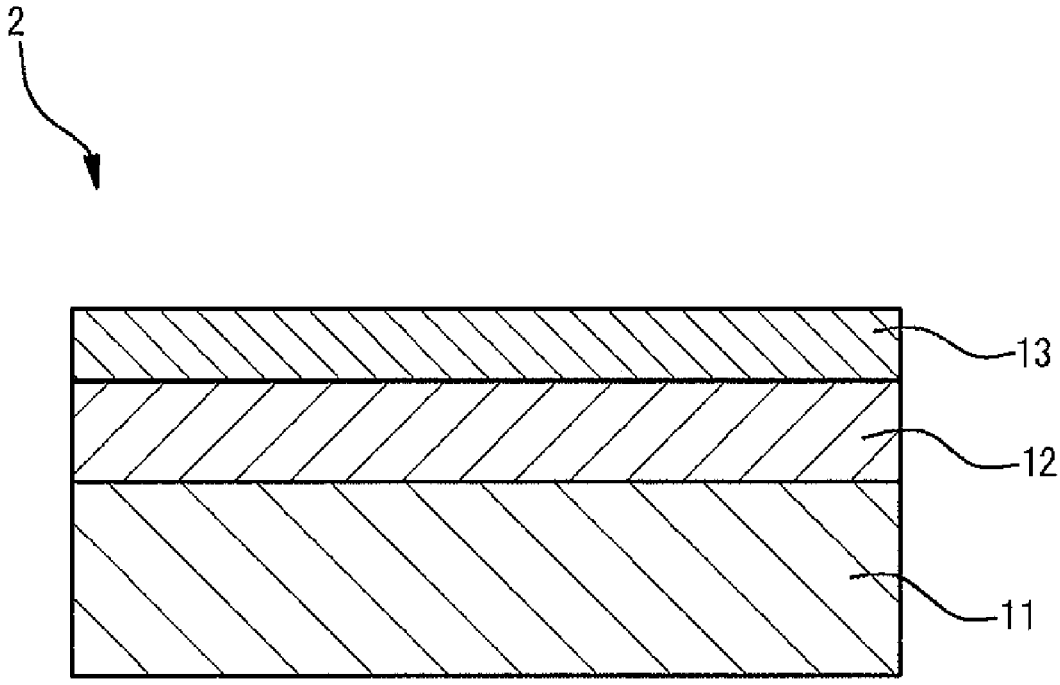
FIG. 2 is a cross-sectional view of a terminal part in a flat conductor constituting the flat cable in FIG. 1.

FIG. 2 is a cross-sectional view of a terminal part of a flat conductor constituting the flat cable in FIG. 1. The flat conductors 2 include copper substrates 11 (copper or a copper alloy), and have tin-copper alloy layers 12 over the copper substrates 11 and zinc-containing tin plating layers 13 over the tin-copper alloy layers 12 in the terminal parts. The electrical connecting portions are either electrically connected to the connector parts of the socket type electrical connector as male contacts, or are electrically connected to the connector parts by soldering so that they are fixed in place.

The thickness of the tin-copper alloy layers 12 in the terminal parts is at least 0.2 μm and not greater than 1.0 μm. The thickness of the zinc-containing tin-plating layers 13 is at least 0.2 μm and not greater than 1.5 μm. The total thickness of the tin-copper alloy layers 12 and the tin plating layers 13 is at least 0.4 μm and not greater than 1.7 μm. When the thickness of the tin-copper alloy layers 12 is less than 0.2 μm, the connections are less reliable, and when the thickness exceeds 1.0 μm, the effects of reducing the formation of whiskers are not reliable. When the thickness of the tin plating layers 13 is less than 0.2 μm, it is likely that some portions will not be plated, which may compromise wettability of solder or corrosion resistance, and when the thickness exceeds 1.5 μm, whiskers are likely to form. When the total thickness exceeds 1.7 μm, the amount of tin supplied increases, whiskers are therefore more likely to form, and the maximum length of the whiskers is greater. Specifically, it is possible to reliably reduce the formation of whiskers in the terminal parts of the flat conductors 2 by laminating tin-copper alloy layers 12 and zinc-containing tin-plating layers 13 having a specific maximum thickness.

The thickness of the tin-copper alloy layers 12 can also be increased in relation to the thickness of the whisker-forming tin plating layers 13 to more effectively inhibit the formation of whiskers. The ratio of the thickness of the tin-copper alloy layers 12 to the sum of the thicknesses of the tin plating layers 13 and tin-copper alloy layers 12 is preferably 50% or greater. The thickness of the tin-copper alloy layers 12 can be measured by cutting a cross section with a focused ion beam (FIB) and observing the cross section with a scanning electron microscope (SEM).

The tin-copper alloy layers 12 can be formed when the tin-plated flat conductors are softened by heat treatment, and inline heating or batch heating can be used as the method of heat treatment. With inline heating, the copper substrates 11 are covered with tin plating by means of electroplating, and the substrates are then passed through a heating furnace at 200° C. to 1000° C. for about 0.01 to about 30 seconds. More desirably, the substrates be passed through a heating furnace at 300° C. to 450° C. for 1 to 3 seconds. With batch heating, the rectangular copper substrates 11 covered with tin plating are either wound around bobbins or laminated with an insulating film, and then are heat-treated in a thermostatic oven at a specific temperature for a specific time. The copper substrates 11 may also be directly heated with an electric current. The percentage of tin-copper alloy layers 12 can be adjusted by the heating temperature and heating time.

The zinc content in the tin plating layers 13 is preferably at least 0.2% and not greater than 20%, because this content can reliably reduce the formation of whiskers without compromising corrosion resistance. When the zinc content is less than 0.2%, the effects of inhibiting whiskers are lessened, and when the zinc content is greater than 20%, corrosion resistance is compromised.

Since the flat cable of the present invention has thin tin plating layers 13, wettability of solder is sometimes reduced in cases in which the electrically connected portions are connected by soldering. In such cases, bismuth can be added to the zinc-containing tin plating to improve wettability of solder in relation to the tin-plating layers 13, which allows for similar soldered connections as in normal circumstances. In this case, the amount of bismuth added to the tin plating layers 13 is preferably at least 2% and not greater than 4%. In cases in which the bismuth content is less than 2%, wettability of solder is insufficient, and in cases in which the bismuth content is greater than 4%, the plating is brittle and likely to crack. Specifically, adding bismuth in an amount of at least 2% and not greater than 4% to the tin plating layers 13 makes it possible to reduce the formation of whiskers and to satisfactorily improve wettability of solder.

Since the flat cable of the present invention has thin tin plating layers 13, microscopic pores are likely to form in the plating surface. Therefore, hydrogen or oxygen enters into the surfaces of the copper substrates 11 via the tin-copper alloy layers 12 through microscopic pores, which causes oxidation and corrosion and may reduce the reliability of the connections. Therefore, the surfaces of the tin plating layers 13 are preferably coated with a sealant. A possible example of the sealant is benzotriazole or another such rust inhibitor dissolved in a solvent.

WORKING EXAMPLES

As flat cables in which flat conductors having tin-copper alloy layers and zinc-containing tin plating layers on copper substrates were aligned in parallel, samples (Working Examples 1, 2, 3; Comparative Examples 1, 2, 4) were prepared. The thickness of the tin-copper alloy layers in the samples was varied, as were the types and amounts of additives included in the tin plating layers (in the Working Examples and Comparative Examples, the copper substrates had tin-copper alloy layers and zinc-containing tin plating layers along the entire length). The terminal parts of the samples were test conductors that were designed to be inserted into jack connectors with the use of a reinforcing plate. The rate of whisker occurrence, the maximum whisker length, and the connection reliability (contact resistance values after the samples had been allowed to stand in high-temperature and high-humidity conditions) in the test conductors were evaluated. For the sake of comparison, samples were also prepared without tin-copper alloy layers (Comparative Examples 3, 5), and these samples were evaluated in the same manner.

The electrically connected portions were fitted into lead-free electrical connectors and allowed to stand at room temperature for 500 hours. The surfaces of the electrically connected portions were then observed with a scanning electron microscope (SEM), and the number of electrically connected portions observed to have whiskers was divided by 200, which was the total number of observations, to determine the rate of whisker occurrence. The maximum whisker length was measured by observation with an SEM. The connection reliability was determined with the following procedure. First, lead-free connectors were fitted on the ends of the flat conductors, and the terminals of these connectors were connected by soldering to connect the circuits in series. In this state, the connectors were allowed to stand for 500 hours at a temperature of 60° C. and a relative humidity of 95%, and the connector portions were then struck lightly to measure the contact resistance values. Table 1 shows the data (tin-copper alloy layer thickness, tin plating layer thickness, zinc content of tin plating layers, bismuth content of tin plating layers) and evaluation results of Working Examples 1 through 3 and Comparative Examples 1 through 5. In Table 1, resistance values of less than 100 mΩ were concluded to be good while resistance values of 100 mΩ or greater were concluded to be poor.

TABLE 1

| | Working Example 1 | Working Example 2 | Working Example 3 | Comparative Example 1 | Comparative Example 2 | Comparative Example 3 | Comparative Example 4 | Comparative Example 5 |
|---|---|---|---|---|---|---|---|---|
| Tin-copper alloy layer thickness (μm) | 1.0 | 0.2 | 0.5 | 0.5 | 0.5 | 0.0 | 1.2 | 0.0 |

TABLE 1-continued

| | Working Example 1 | Working Example 2 | Working Example 3 | Comparative Example 1 | Comparative Example 2 | Comparative Example 3 | Comparative Example 4 | Comparative Example 5 |
|---|---|---|---|---|---|---|---|---|
| Nickel layer thickness (μm) | — | — | — | — | — | — | — | 1.0 |
| Zinc-containing tin plating layer thickness (μm) | 0.2 | 1.5 | 0.5 | 0.1 | 1.6 | 0.5 | 0.5 | 1.0 |
| Zinc content (%) | 5 | 5 | 5 | 5 | 5 | 5 | 5 | 5 |
| Bismuth content (%) | 0 | 0 | 3 | 0 | 0 | 0 | 0 | 0 |
| Rate of whisker occurrence (%) | 15 | 20 | 5 | 3 | 20 | 3 | 30 | 15 |
| Maximum whisker length (μm) | 45 | 45 | 30 | 20 | 80 | 15 | 70 | 90 |
| Connection reliability | good | good | good | poor | good | poor | good | good |

The fluctuations in contact resistance values after the connectors were left in high-temperature and high-humidity conditions were less than 100 mΩ in Comparative Examples 2, 4, and 5, but were 100 mΩ or greater in Comparative Examples 1 and 3, and reliability was poor in Comparative Examples 1 and 3. Comparative Examples 2, 4, and 5 had undesirable maximum whisker lengths of 70 to 90 μm.

In Working Examples 1 through 3, wherein the tin-copper alloy layer thickness was at least 0.2 μm and not greater than 1.0 μm, the zinc-containing tin plating layer thickness was at least 0.2 μm and not greater than 1.5 μm, and the total thickness of the tin-copper alloy layer and zinc-containing tin plating layers was at least 0.4 μm and not greater than 1.7 μm, the fluctuations in resistance values were less than 100 mΩ, stable electrical connections were obtained, and the connections were highly reliable. Additionally, the rate of whisker occurrence in Working Examples 1 through 3 was 20% at maximum, the maximum whisker length was 45 μm at maximum, and the rate of whisker occurrence was lowered while the lengths were reduced. Including bismuth in the tin plating layers as in Working Example 3 makes it possible to more satisfactorily inhibit the occurrence of whiskers and to reduce the length of the whiskers.

While this invention has been described in connection with what is presently considered to be the most practical and preferred embodiments, the invention is not limited to the disclosed embodiments, but, on the contrary, is intended to cover various modifications and equivalent arrangements included within the spirit and scope of the appended claims.

The entire disclosure of Japanese Patent Application No. 2006-000941 filed on Jan. 5, 2006, including the specification, claims, drawings, and summary, is incorporated herein by reference in its entirety.

What is claimed is:

1. A flat cable comprising:

(1) a plurality of flat conductors each including a copper substrate, the flat conductors being aligned in a plane; and (2) an insulating resin that covers the flat conductors, at least a terminal part of each of the flat conductors having a tin-copper alloy layer formed on the copper substrate and a zinc-containing tin plating layer formed on the tin-copper alloy layer, with a thickness of the tin-copper alloy layer being at least 0.2 μm and not greater than 1.0 μm, a thickness of the zinc-containing tin plating layer being at least 0.2 μm and not greater than 1.5 μm, a total thickness of the tin-copper alloy layer and the zinc-containing tin plating layer being at least 0.4 μm and not greater than 1.7 μm, the zinc content in the zinc-containing tin plating layer is at least 0.2% and not greater than 20%, and the zinc-containing tin plating layer contains an amount of at least 2% and not greater than 4% of bismuth.

2. The flat cable according to claim 1, wherein the tin-copper alloy layer has a thickness that is less than the thickness of the zinc-containing tin plating layer.

* * * * *